United States Patent [19]

Uthoff, Jr.

[11] Patent Number: 4,643,655

[45] Date of Patent: Feb. 17, 1987

[54] BACKFLOW PASSAGE FOR ROTARY POSITIVE DISPLACEMENT BLOWER

[75] Inventor: Loren H. Uthoff, Jr., Canton, Mich.

[73] Assignee: Eaton Corporation, Cleveland, Ohio

[21] Appl. No.: 805,022

[22] Filed: Dec. 5, 1985

[51] Int. Cl.[4] ..... F04C 18/16

[52] U.S. Cl. ..... 418/201; 418/206

[58] Field of Search ..... 418/201, 203, 206, 15

[56] References Cited

U.S. PATENT DOCUMENTS

| | | | |
|---|---|---|---|
| 1,746,885 | 2/1930 | Bunge et al. . | |
| 2,014,932 | 9/1935 | Hallett | 418/83 |
| 2,028,414 | 1/1936 | Schneider | 230/141 |
| 2,078,334 | 4/1937 | Martocello | 418/203 |
| 2,259,027 | 10/1941 | De Zarate et al. | 418/206 |
| 2,448,901 | 8/1943 | McCulloch et al. | 418/206 |
| 2,454,048 | 11/1948 | Flanagan | 230/141 |
| 2,463,080 | 2/1945 | Beier | 418/206 |
| 2,480,818 | 8/1949 | Whitfield | 103/128 |
| 2,906,448 | 9/1959 | Lorenz | 230/210 |
| 3,058,652 | 10/1962 | Glamann | 230/138 |
| 3,121,529 | 2/1964 | Hubrich | 418/203 |
| 3,531,227 | 9/1970 | Weatherston | 418/94 |
| 3,667,874 | 6/1972 | Weatherston et al. | 418/9 |
| 3,844,695 | 10/1974 | Weatherston | 418/180 |
| 4,042,062 | 8/1977 | Tooley | 181/36 |
| 4,135,602 | 1/1979 | Clark | 181/230 |
| 4,215,977 | 8/1980 | Weatherston | 418/1 |

*Primary Examiner*—John J. Vrablik
*Assistant Examiner*—Jane E. Obee
*Attorney, Agent, or Firm*—D. A. Rowe; P. S. Rulon

[57] ABSTRACT

An improved rotory positive displacement blower (10) of the Roots-type with reduced airborne noise and superior efficiency. The blower includes a housing (12) defining generally cylindrical chambers (32, 34) having cylindrical wall surfaces (20*a*, 20*b*) and containing meshed lobed rotors (14, 16) having the lobes (14*a*, 14*b*, 14*c*, 16*a*, 16*b*, 16*c*) thereon formed with an end-to-end helical twist according to the relation 360°/2n, where n equals the number of lobes per rotor. Preferably, n equals three. The blower housing (12) also defines inlet and outlet ports (36, 38) and the intersections of wall surfaces (20*a*, 20*b*) define a cusp (20*d*) associated with the inlet port (36) and a cusp (20*e*) associated with outlet port (38). The inlet and outlet port openings are skewed in opposite directions to increase the time the top lands of the lobes are in sealing relation with cylindrical walls (20*a*, 20*b*) of chambers (32, 34). Transverse boundaries (20*g*, 20*i*) of the inlet port are traversed by the lobes prior to traversal of the inlet port cusp (20*d*) by trailing ends (14*h*, 16*h*) of the lobes. In a similar manner, the transverse boundaries (20*n*, 20*r*) of the outlet port are traversed by the lobes subsequent to traversal of the outlet port cusp (20*e*) by leading ends (14*g*, 16*g*) of the lobes. A portion of the cusp (20*e*) adjacent leading ends (14*g*, 16*g*) of the lobes is removed to provide a backflow passage for intercommunicating transfer volumes of one rotor not in direct communication with the outlet port with transfer volumes of the other rotor already in direct communication with the outlet port.

12 Claims, 6 Drawing Figures

24
26
2
2
24a
4
3
20
10
12
20c
26
22a
22
18
40
1
1

BACKFLOW PASSAGE FOR ROTARY POSITIVE DISPLACEMENT BLOWER

CROSS-REFERENCE TO RELATED APPLICATION

This application relates to U.S. application Ser. No. 652,536, filed 9-20-84, now U.S. Pat. No. 4,609,335 assigned to the assignee of this application, and incorporated herein by reference.

BACKGROUND OF THE INVENTION

1. Field of the Invention

This invention relates to rotary, positive displacement blowers of the backflow type. More specifically, the present invention relates to reducing noise and/or improving efficiency of a Roots-type blower employed as a supercharger for an internal combusion engine.

2. Description of the Prior Art

Rotary blowers of the Roots-type have long been characterized by noisy and/or inefficient operation. Attempts to decrease the source of the noise have generally decreased efficiency. The blower noise may be roughly classified into two groups: solid-borne noise caused by rotation of timing gears and rotor shaft bearings subjected to fluctuating loads, and fluid-borne noise caused by fluid flow characteristics such as rapid changes in fluid velocity and pressure. Rapid fluctuations in fluid flow and pressure also contribute to solid-borne noise.

As is well known, Roots-type blowers are similar to gear-type pumps in that both employ toothed or lobed rotors meshingly disposed in transversely overlapping cylindrical chambers and in that both transfer volumes of fluid from an inlet port to an outlet port via spaces between unmeshed teeth or lobes of each rotor without mechanical compression of the fluid. In both the Roots and gear devices, the top lands and ends of the unmeshed teeth or lobes of each rotor are closely spaced from the inner surfaces of the cylindrical chamber to effect a sealing cooperation therebetween. Since gear pumps are used almost exclusively to pump or transfer volumes of lubricious fluids, such as oil, the meshing teeth therein may contact to form a seal between the inlet and outlet ports. On the other hand, since Roots-type blowers are used almost exclusively to pump or transfer volumes of nonlubricious fluid, such as air, timing gears are used to maintain the meshing lobes in closely spaced, non-contacting relation to form the seal between the inlet and outlet ports.

This sealing arrangement between the meshing lobes, and between the lobes and cylindrical chamber surfaces makes a Roots-type blower substantially more prone to internal leakage than a gear pump. The liquid of a gear pump is substantially more viscous than the air of a Roots-type blower; therefore, oil is more leak-resistant. At any given time, a gear pump has several teeth per rotor in sealing relation with the cylindrical chamber surfaces which form a very effective labyrinth seal, whereas a Roots-type blower often has only one lobe per rotor in such sealing relation. Accordingly, Roots-type blowers are prone to internal leakage. The leakage, as a precentage of total displacement, increases with increasing boost pressure or pressure ratio and increases with decreasing speed of the rotors.

As previously mentioned, the transfer volumes of air trapped between the adjacent unmeshed lobes of each rotor are not mechanically compressed. Air, of course, is a compressible fluid. Accordingly, if the boost or outlet port air pressure is greater than the air pressure in the transfer volumes, outlet port air rushes or backflows into the transfer volumes as they move into direct communication with the outlet port with resultant rapid fluctuations in fluid volocity and pressure. Such fluctuations, due to backflow, are known major sources of airborne noise. In general, the noise increases with increasing pressure ratio and rotor speed.

Other major sources of airborne noise are cyclic variations in volumetric displacement of the blower due to meshing geometry of the lobes, and outlet air which is abruptly trapped between the remeshing lobes and abruptly returned to the inlet port. When a Roots-type blower is employed as a supercharger to boost the air or air/fuel charge of an internal combustion engine in a land vehicle, such as a passenger car, the blower is required to operate over wide speed and pressure ranges; for example, speed ranges of 2,000 to 16,000 RPM and pressure ratios of 1:1 to 1:8 are not uncommon. Prior art efforts to cost-effectively reduce or eliminate airborne noise from Roots-type blowers in such supercharger applications have, at best, met with limited success. In general, the efforts have successfully reduced airborne noise only for limited operating conditions of the blower, i.e., for specific boost pressure and rotor speed combinations. For example, a concept may effectively reduce airborne noise by reducing rapid fluctuations in fluid velocity and pressure at a high rotor speed and a high boost pressure; however, the concept is often totally ineffective at low rotor speed and high boost pressure. Further, in many cases, the efforts have increased internal leakage of the blower and, thereby, have decreased volumetric efficiency of the blower, have decreased energy efficiency, have undesirably increased the temperature of the boosted air, and have undesirably required an increase in blower size and/or speed.

U.S. Pat. No. 2,014,932 to Hallett addresses the problem of airborne noise; therein Hallett teaches that non-uniform displacement, due to meshing geometry, is reduced by employing helical twist lobes in lieu of straight lobes. Hallett asserts that helical lobed rotors, each having three lobes circumferentially spaced 120° apart with a 60° helical twist, best effects a compromise between the requirements of maximum displacement for a blower of given dimensions and a maximum frequency of pulsations of lesser magnitude. Theoretically, such helically twisted lobes would provide uniform displacement were it not for cyclic backflow and air trapped between the remeshing lobes.

Hallett also addresses the backflow problem and proposes reducing the initial rate of backflow to reduce the instantaneous magnitude of the backflow pulses. This is done by mismatched or rectangular-shaped inlet and output ports each having two sides parallel to the rotor axes and, therefore, skewed relative to the traversing top lands of the helical lobes. The parallel sides of the ports are positioned such that the cylindrical surface of each rotor chamber is a 180° arc. With this lobe-port configuration, the lead lobe of each transfer volume traverses its associated outlet port boundary (i.e., the parallel sides) just as the trailing lobe of the transfer volume moves into sealing relation with the cylindrical wall surface; such an arrangement maximizes the time the trailing lobe is exposed to boosted or increased differential pressure and, thereby, maximizes the time for and rate of leakage across the trailing lobes.

Several other prior art patents also address the backflow problem by preflowing outlet port air into the transfer volumes before the top lands of the leading lobe of each transfer volume traverses the outer boundary of the outlet port. In some of these patents, as disclosed in U.S. Pat. No. 8,121,529 to Hubrich, preflow is provided by passages through the housing's cylindrical walls which sealingly cooperate with the top lands of the lobes. In U.S. Pat. No. 4,215,977 to Weatherston, preflow is provided in a manner similar to that of Hubrich. In a second embodiment of Wheatherston, preflow is provided by accurate channels or slots formed in the inner surfaces of the cylindrical walls which sealingly cooperate with the top lands of the lobes. The preflow arrangements of Hubrich and Weatherston, as with the backflow arrangement of Hallett, expose the trailing lobes of each transfer volume to boosted or increased pressure differential just as the trailing lobes move into sealing cooperation with the cylindrical wall surfaces and thereby undesirably maximize the time for and rate of leakage across the trailing lobes.

SUMMARY OF THE INVENTION

An object of this invention is to provide a rotary blower of the backflow type for compressible fluids which is relatively free of airborne noise and yet is high in volumetric efficiency.

According to a feature of the present invention, a rotary blower of the backflow type includes a housing defining two parallel, transversely overlapping, cylindrical chambers having internal cylindrical and end wall surfaces, the axes of the cylindrical chambers defining a longitudinal direction and the end walls defining a transverse direction, and each intersection of the cylindrical wall surfaces defining a cusp extending in the longitudinal direction between the end walls; an inlet port and an outlet port having longitudinal and transverse boundries defined on opposite sides of the chambers with the transverse boundaries of each port disposed on opposite sides of a plane extending longitudinally through the cusps; meshed lobed rotors rotatably disposed in the chambers, the ends of the rotors and lobes sealing cooperating with the end wall surfaces, each lobe of each rotor having a top land sealingly cooperating with the cylindrical wall surface of the associated chamber and operative to traverse the port boundaries disposed on the associated side of the plane for effecting transfer of volumes of compressible inlet port fluid to the outlet port via spaces between adjacent unmeshed lobes of each rotor, the lobes being formed with a helical twist such that each lobe has a leading end and a trailing end in the direction of rotor rotation, and the positioning of the lobes being such that traversal of a portion of the plane associated with the outlet port cusp by the lobe lead end of one rotor communicates a transfer volume of one rotor with a transfer volume of the other rotor independent of the outlet port; the improvement comprising; skewing the outlet port toward the trailing ends of the lands with the boundaries of the outlet port being disposed such that the lead ends of the lobes traverse the plane portion prior to traversal of the outlet port boundaries by the lobe top lands; and a backflow passage extending traversely through the cusp associated with said outlet port, the channel being disposed at the longitudinal end of the outlet port cusp associated with the lead ends of the lobes for intercommunicating transfer volumes of one rotor will transfer volumes of the other rotor prior to the lobe lead ends of the one rotor traversing the plane portion. According to another feature of the invention, the backflow passage of the previous feature is formed by removal of a portion of the outlet port cusp.

BRIEF DESCRIPTION OF THE DRAWINGS

A Roots-type blower intended for use as a supercharger is illustrated in the accompanying drawings in which.

DETAILED DESCRIPTION OF THE DRAWINGS

FIGS. 1–4 illustrate a rotary pump or blower 10 of the Roots-type. As previously mentioned, such blowers are used almost exclusively to pump or transfer volumes of compressible fluid, such as air, from an inlet port to an outlet port without compressing the transfer volumes prior to exposure to the outlet port. The rotors operate somewhat like gear-type pumps, i.e., as the rotor teeth or lobes move out of mesh, air flows into volumes or spaces defined by adjacent lobes on each rotor. The air in the volumes is then trapped therein at substantially inlet pressure when the top lands of the trailing lobe of each transfer volume move into a sealing relation with the cylindrical wall surfaces of the associated chamber. The volumes of air are transferred or directly exposed to outlet air when the top land of the leading lobe of each upcoming volume moves out of sealing relation with the cylindrical wall surfaces by traversing the boundary of the outlet port. If helical lobes are employed, the volume of air may also be indirectly exposed to outlet port air via a transfer volume of the other rotor whose lead lobe has already transversed the outlet port boundary by virtue of the lead end of each helical lobe traversing the cusp defined by the intersection of the cylindrical chamber surfaces and associated with the outlet port. This indirect communication aspect of a Roots-type blower prevents mechanical compression of the transfer volume fluid and distinguishes a Roots-type blower from a conventional screw-type blower. If the volume of each transfer volume remains constant during the trip from inlet to outlet, the air therein remains substantially at inlet pressure, i.e., transfer volume air pressure remains constant if the top land of the leading lobe traverses the outlet port boundary before the volume is squeezed by virtue of remeshing of the lead lobe. Hence, if air pressure at the discharge port is greater than inlet port pressure, outlet port air rushes or backflows into the transfer volumes as the top lands of the leading lobes traverse the outlet port boundary.

Figure 1:
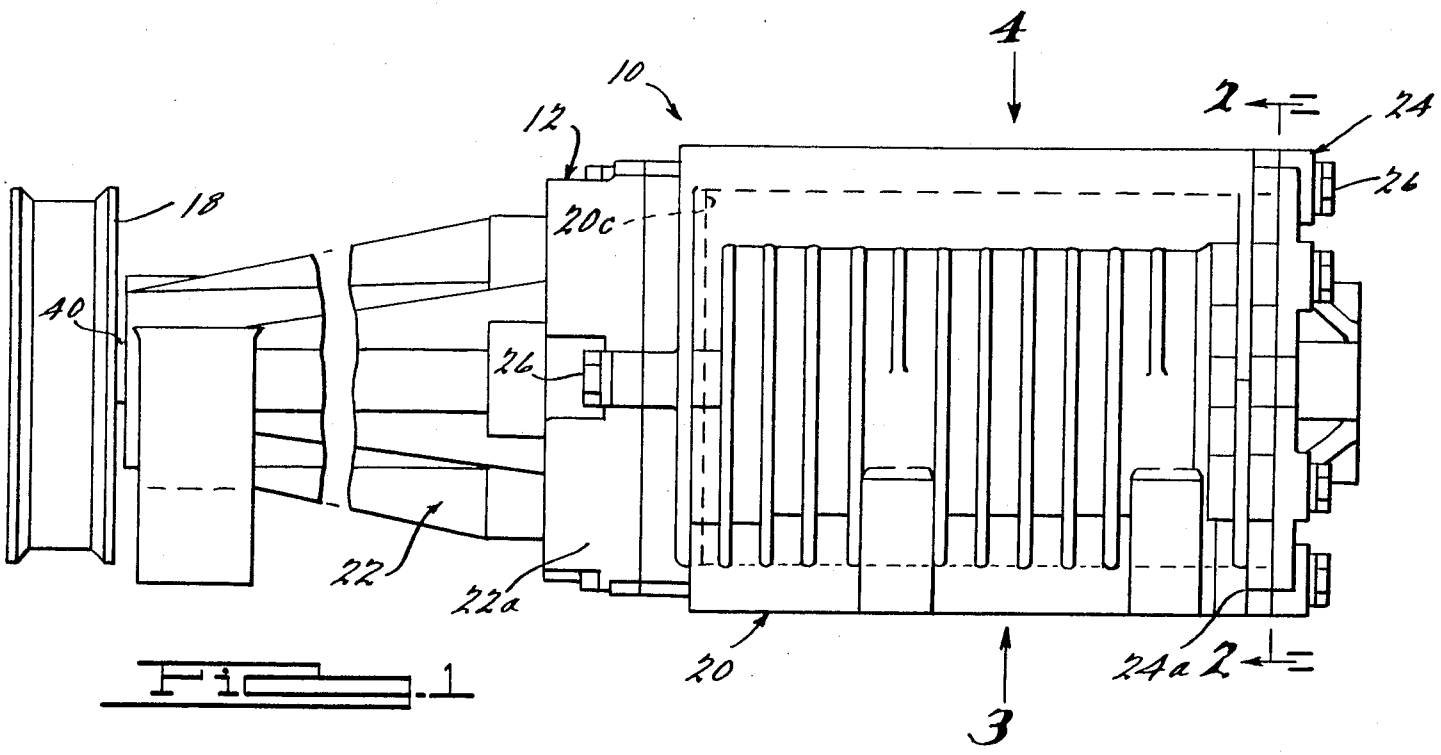
FIG. 1 is a side elevational view of the Roots-type blower.
Figure 2:
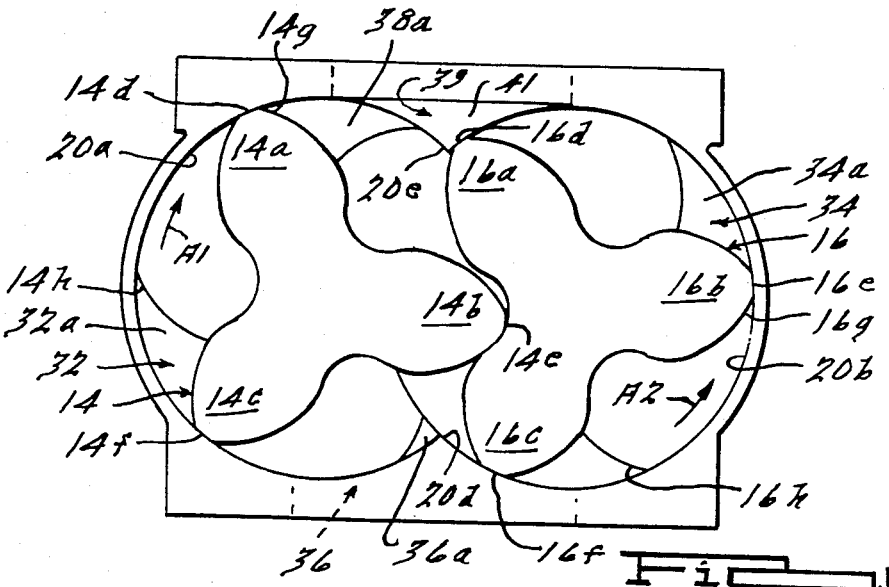
FIG. 2 is a schematic sectional view of the blower looking along line 2—2 of FIG. 1.
Figure 3:
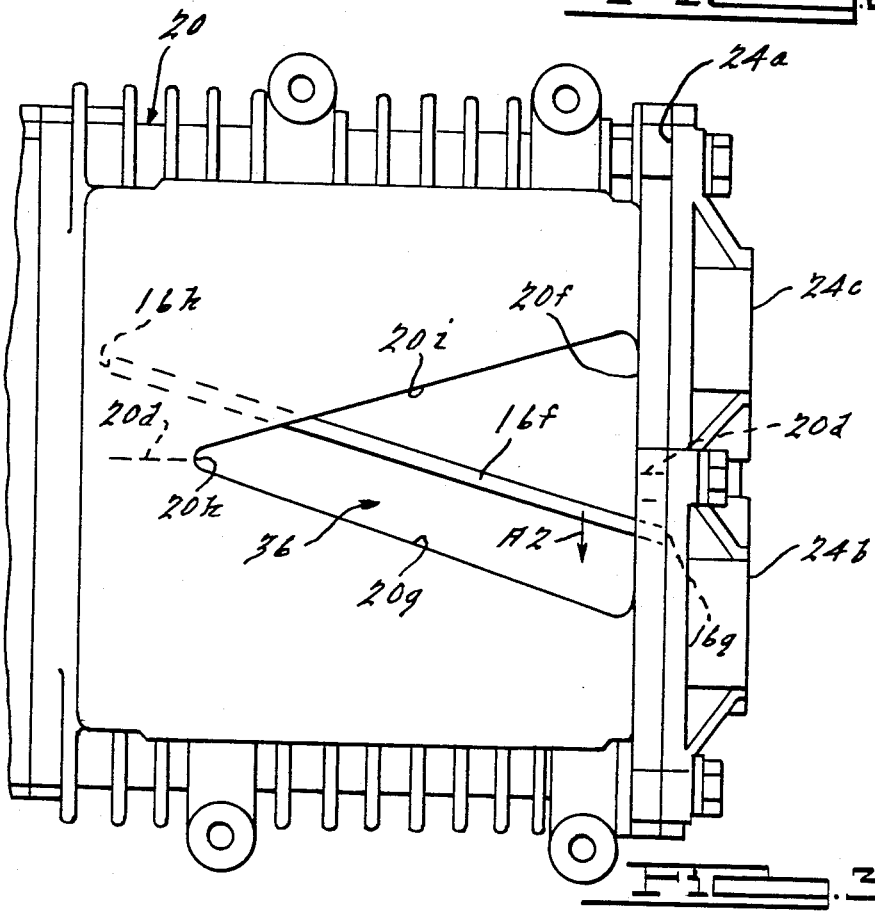
FIG. 3 is a bottom view of a portion of the blower looking in the direction of arrow 3 in FIG. 1 and illustrating an inlet port configuration.
Figure 4:
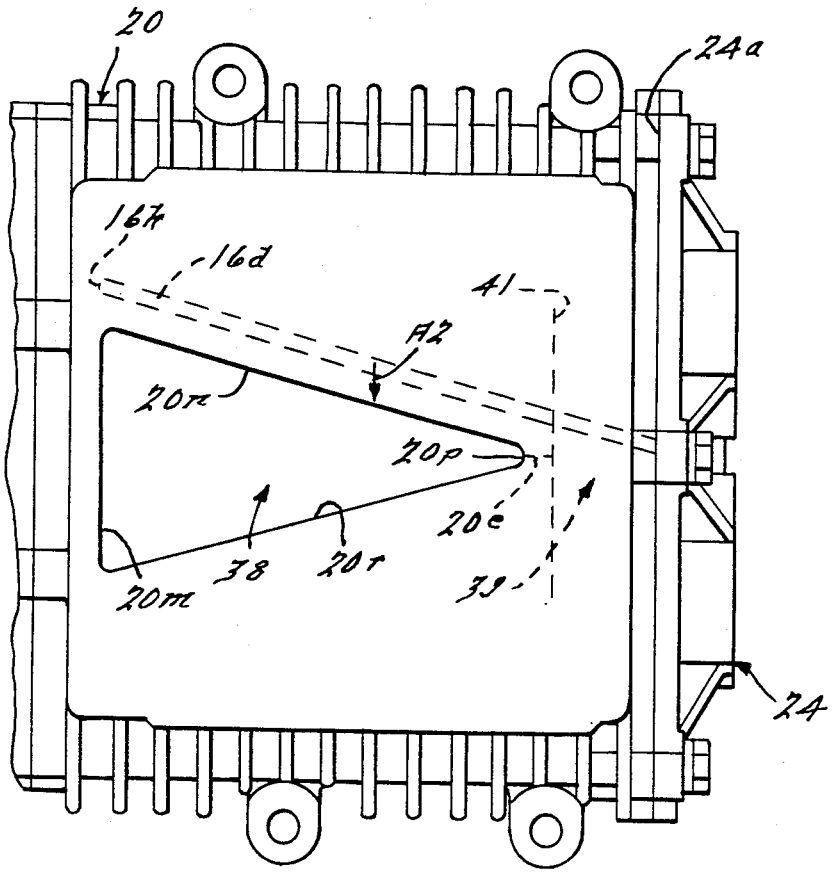
FIG. 4 is a top view of a portion of the blower looking in the direction of arrow 4 of FIG. 1 and illustrating an outlet port configuration.

Blower 10 includes a housing assembly 12, a pair of lobed rotors 14, 16, and an input drive pulley 18. Housing assembly 12, as viewed in FIG. 1, includes a center section 20, and left and right end sections 22, 24 secured to opposite ends of the center section by a plurality of bolts 26. The rotors rotate in opposite directions as shown by the arrows $A_1$, $A_2$ in FIG. 2. The housing assembly and rotors are preferably formed from a lightweight material such as aluminum. The center section and end 24 define a pair of generally cylindrical working chambers 32, 34 circumferentially defined by cylindrical wall portions or surfaces 20*a*, 20*b*, an end wall surface indicated by phantom line 20*c* in FIG. 1, and an end wall surface 24*a*. Openings 36, 38 in the bottom and top of center section 20 respectively define the transverse and longitudinal boundaries of inlet and outlet ports. Chambers 32, 34 transversely overlap or intersect at cusps 20*d*, 20*e* respectively associated with the inlet ports and outlet ports, as seen in FIGS. 2–4. Substantial portions of cusps 20*d*, 20*e* are removed by the inlet and outlet port openings and the end of cusp 20*e* adjacent end wall surface 24*a* is removed to provide a backflow channel or passage 39 to be further explained hereinafter. Passage 39 extends from the end wall surface 24*a* to wall portion 41 shown by phantom line in FIG. 4. The ends of passage 39 tangently intersect the cylindrical wall surfaces of chambers 32, 34 and, hence, do not form edges representable by phantom lines.

Rotors 14, 16 respectively include three circumferentially spaced apart helical teeth or lobes 14*a*, 14*b*, 14*c* and 16*a*, 16*b*, 16*c* of modified involute profile with an end-to-end twist of 60°. The lobes or teeth mesh, preferably do not touch, and are maintained in proper registry or phase relation by low backlash timing gears as further discussed hereinafter. The lobes also include top lands 14*d*, 14*e*, 14*f*, and 16*d*, 16*e*, 16*f*. The lands move in close sealing noncontacting relation with cylindrical wall surfaces 20*a*, 20*b* and with the root portions of the lobes they are in mesh with. Since the lobes are helical, an end 14*g*, 16*g* of each lobe on each rotor leads the other end 14*h* 16*h* in the direction of rotor rotation. Rotors 14, 16 are respectively mounted for rotation in cylindrical chambers 32, 34 about axes substantially coincident with the longitudinally extending, transversely spaced apart, parallel axes of the cylindrical chambers. Such mountings are well-known in the art. Hence, it should suffice to say that unshown shaft ends extending from and fixed to the rotors are supported by unshown bearings carried by end wall 20*c* and end section 24. Bearings for carrying the shaft ends extending rightwardly into end section 24 are carried by outwardly projecting bosses 24*b*, 24*c*. The rotors may be mounted and timed as shown in European patent application No. 84304078.3, published Mar. 27, 1985 and incorporated herein by reference. Rotor 16 is directly driven by pulley 18 which is fixed to the left end of a shaft 40. Shaft 40 is either connected to or an extension of the shaft end extending from the left end of rotor 16. Rotor 14 is driven in a conventional manner by unshown timing gears fixed to the shaft ends extending from the left ends of the rotors. The timing gears are of the substantially no backlash type and are disposed in a chamber defined by a portion 22*a* of end section 22.

The rotors, as previously mentioned, have three circumferentially spaced lobes of modified involute profile with an end-to-end helical twist of 60°. Rotors with other than three lobes, with different profiles and with different twist angles, may be used to practice certain aspects or features of the inventions disclosed herein. However, to obtain uniform displacement based on meshing geometry and trapped volumes, the lobes are preferably provided with a helical twist from end-to-end which is substantially equal to the relation 360°/2n, where n equals the number of lobes per rotor. Further, involute profiles are also preferred since such profiles are more readily and accurately formed than most other profiles; this is particularly true for helically twisted lobes. Still further, involute profiles are preferred since they have been more readily and accurately timed during supercharger assembly. Excessive pressure buildup of air trapped between the remeshing lobes may be relieved by the method taught in copending U.S. application Ser. No. 647,074 filed Sept. 4, 1984, now U.S. Pat. No. 4,569,646.

As may be seen in FIG. 2, the rotor lobes and cylindrical wall surfaces sealingly cooperate to define an inlet receiver chamber 36*a*, an outlet receiver chamber 38*a*, and transfer volumes 32*a*, 34*a*. For the rotor positions of FIG. 2, inlet receiver chamber 36*a* is defined by portions of the cylindrical wall surfaces disposed between top lands 14*f*, 16*e* and the mesh of lobes 14*b*, 16*c*. Likewise, outlet receiver chamber 38*a* is defined by portions of the cylindrical wall surfaces disposed between top lands 14*d*, 16*d* and the mesh of lobes 14*b*, 16*c*. The cylindrical wall surfaces defining both the inlet and outlet receiver chambers include those surface portions which were removed to define the inlet and outlet port openings. Transfer volume 32*a* is defined by adjacent lobes 14*a*, 14*c* and the portion of cylindrical wall surfaces 20*a* disposed between top lands 14*d*, 14*f*. Likewise, transfer volume 34*a* is defined by adjacent lobes 16*a*, 16*b* and the portion of cylindrical wall surface 20*b* disposed between top lands 16*d*, 16*e*. As the rotors turn, transfer volumes 32*a*, 34*a* are reformed between subsequent pairs of adjacent lobes. Each transfer volume includes a leading lobe and a trailing lobe. For transfer volume 32*a*, lobe 14*a* is a leading lobe and lobe 14*c* is a trailing lobe.

Inlet port 36 is provided with a triangular opening by wall surfaces 20*f*, 20*g*, 20*h*, 20*i* defined by housing section 20. Wall surfaces 20*f*, 20*h* define the longitudinal boundaries or extent of the port and wall surfaces 20*g*, 20*i* define the transverse boundaries or extent of the port. Transverse boundaries 20*g*, 20*i* are disposed on opposite sides of an imaginary or unshown plane extending through the longitudinal intersection of the chambers and cusps 20*d*, 20*e*. The transverse boundaries or wall surfaces 20*g*, 20*i* are matched or substantially parallel to the traversing top lands of the associated lobes and the longitudinal boundary 20*f* is disposed substantially at the leading ends 14*g*, 16*g* of the lobes. This arrangement skews the major portion of the inlet port opening toward the lead ends 14*g*, 16*g* of the lobes and their top lands. Further, the transverse boundaries are positioned such that the lands of the associated lobes traverse wall surfaces 20*g*, 20*i* prior to traversing of the unshown plane or cusp 20*d* associated with the inlet port by the trailing ends 14*h*, 16*h* of the lobes. Wall surfaces 20*g*, 20*i* may be spaced further apart than shown herein if additional inlet port area is needed to prevent a pressure drop across the inlet port. Such a pressure drop situation could arise if the rotor rotational speed was increased beyond the 14,000 to 16,000 RPM range contemplated for the blower herein. The top lands of the helically twisted lobes in FIGS. 3 and 4 are schematically illustrated as being diagonally straight for simplicity herein. However, as viewed in these figures, such lands actually have a curvature. Wall surfaces 20*g*, 20*i* may also be curved to more closely conform to the helical twist of the top lands.

Outlet port 38 is provided with a triangular opening by wall surfaces 20*m*, 20*n*, 20*p*, 20*r* defined by housing section 20. Wall surfaces 20*m*, 20*p* define the longitudinal boundaries or extent of the port and wall surfaces 20*n*, 20*r* define the transverse boundaries or extent of the port. Transverse boundaries 20*n*, 20*r* are disposed on opposite sides of the imaginary or unshown plane extending through the longitudinal intersection of the chambers and cusps 20*d*, 20*e*. The transverse boundaries or wall surfaces 20*n*, 20*r* are matched or substantially parallel to the traversing top lands of the associated lobes and the longitudinal boundary 20*m* is disposed substantially at the trailing ends 14*h*, 16*h* of the lobes. This arrangement skews the major portion of the outlet port opening toward the trailing ends 14*h*, 16*h* of the lobes and their top lands. Further, the transverse boundaries 20*n*, 20*r* are positioned such that the lands of the associated lobes traverse wall surfaces 20*n*, 20*r* after the leading ends 14*g*, 16*g* of the lobes traverse a portion of the unshown plane passing through the portion of cusp 20*e* removed to form backflow channel 39. The area of outlet port may be increased in the manner mentioned above for the inlet port. In general, the longitudinal extent of the inlet and outlet ports may extend substantially the full length of the lobes.

The blower, as thus far described, has virtually no airborne noise due to meshing geometry of the rotor lobes since the lobes are formed according to the relation 360°/2n. The blower also has a particularly high or superior volumetric efficiency, independent or rotor speed, since the inlet and outlet port openings are respectively skewed toward the lead and trailing ends of the rotor lobes so as to minimize the time full outlet port air pressure is directly exposed to the trailing loe of each upcoming transfer volume and so as to maximize the seal time of the top lands of the trailing lobes of each upcoming transfer volume. Were it not for partial removal of cusp 20*e* adjacent end wall surface 24*a*, the trailing lobe of each transfer volume would be in sealing relation for at least 80° prior to traversal of cusp 20*e* at its end normally adjacent end wall 24*a*. Traversal of this portion of cusp 20*e* by the leading ends of the lead lobes indirectly communicate the upcoming transfer volumes of one rotor with the outlet port air via transfer volumes of the other rotor whose lead lobes have already traversed their associated outlet port boundary. For example, and supposing the portion of cusp 20*e* is not removed, when lead end 16*g* of lobe 16*a* initially traverses outlet port cusp 20*e*, as may be seen in FIG. 4, its associated outlet port boundary 20*n* has not been traversed. Hence, there is no direct communication with outlet port air. However, there is indirect communication via air in receiver chamber 38*a*, i.e., air from a transfer volume of rotor 14. This indirect communication aspect of a Roots-type blower, as previously mentioned, prevents mechanical or internal compression of transfer volume fluid prior to direct or indirect communication with the outlet port and is an aspect which distinguishes a Roots-type blower with helical lobes from a conventional screw-type blower.

This lack of mechanical or internal compression causes air borne noises generated by fluid velocity and pressure fluctuations produced by the rush or backflow of outlet port air and outlet receiver air into each upcoming transfer volume when the lead lobe of the upcoming transfer volume transverses the outlet port boundaries. The greater the pressure differential between outlet port air and transfer volume air so to are the fluid velocity and pressure fluctuations. Such airborne noises, which are proportional to the percentage of pressure change in receiver chamber 38*a*, have been greatly reduced by removing the portion of cusp 20*e* adjacent end wall 24*a* to provide increased indirect communication of outlet port air to each upcoming transfer volume prior to rapid direct communication by traversal of the associated outlet port boundaries. The channel or passage 39 provided by removing a portion of cusp 20*e* is readily sized in flow area so as to provide a gradual increase in the air pressure of the upcoming transfer volume.

Figure 5:
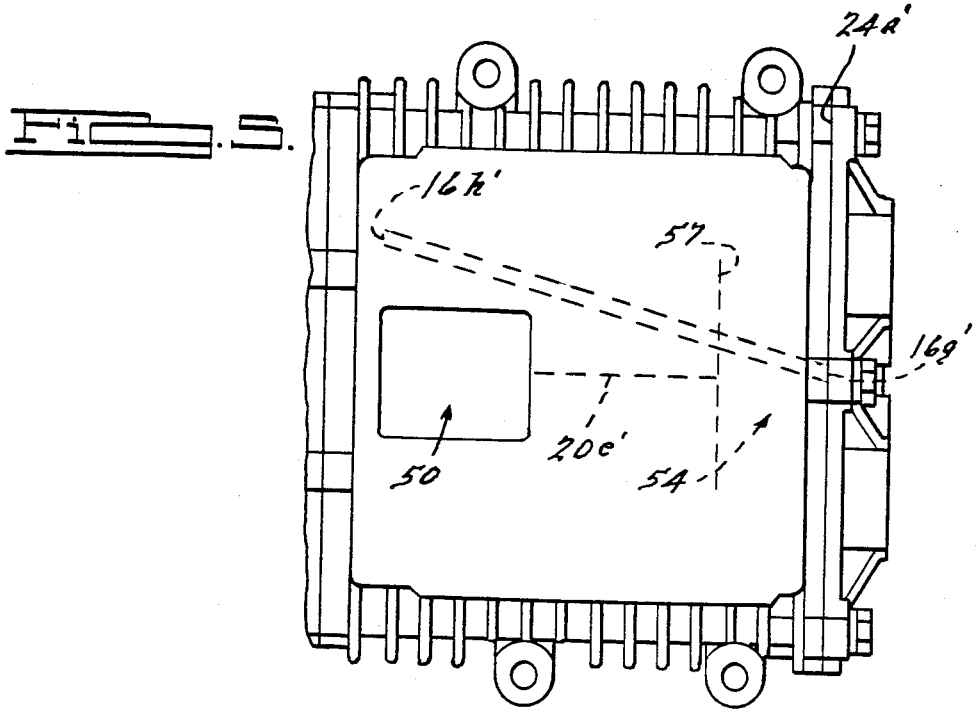
FIG. 5 is reduced in size and illustrates an alternative embodiment of the outlet port with the rotor lands positioned according to FIG. 4.
Figure 6:
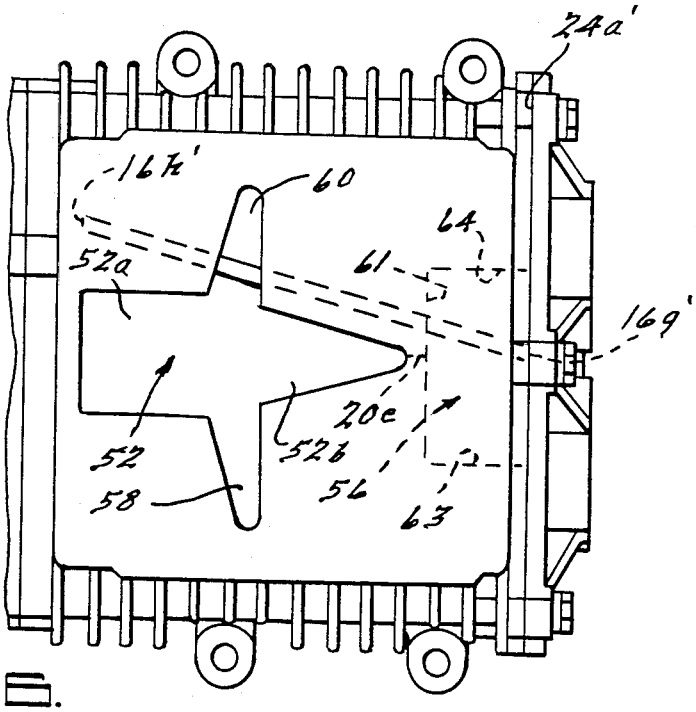
FIG. 6 is also reduced in size and illustrates a second alternative embodiment of the outlet port with the rotor lands positioned according to FIG. 4.

FIGS. 5 and 6 illustrate two of many alternative outlet port shapes 50, 52 usable in combination with removal of a portion of cusp 20*e* to provide backflow passages or channels 54, 56. Components in FIGS. 6 and 7 which are identical to like components in FIGS. 1–4 are identified by the same reference characters suffixed with a prime.

Port 50 of FIG. 5 is rectangular in shape and like port 38 its opening is skewed toward the trailing ends of the rotor lobes. Backflow passage 54 is somewhat wider than backflow passage 39 to provide faster backflow at higher rotor speeds and/or at lesser pressure ratios. Passage 54 extends from end wall surface 24*a*′ to a wall portion 57 defined by the cusp removal. The ends of passage tangently intersect the cylindrical wall surfaces of chambers 32, 34; hence, they do not form edges representable by phantom lines.

Port 52 of FIG. 6 includes a rectangular portion 52*a* and a triangular portion 52*b*, and like ports 38, 50 its opening is skewed toward the trailing ends of the rotor lobes. Port 52 is also provided with expanding orifices 58, 60 which provide additional backflow into each upcoming transfer volume prior to traversal of the outlet port boundaries defined by rectangular portion 52*a* and triangular portion 52*b*. Backflow passage 56 is wider than backflow passages 39 and 54 and extends widthwise from end wall surface 24*a*′ to a wall portion 61. Passage 56 is also not cut as deep into the housing; hence, it is shorter in the traverse direction of the blower and has end edges represented by phantom lines 63, 64.

The preferred embodiment of the invention has been disclosed herein in detail for illustrative purposes. Many variations of the disclosed embodiment are believed to be within the spirit of the invention. The following claims are intended to cover inventive portions of the disclosed embodiment and modifications believed to be within the spirit of the invention.

What is claimed is:

1. In a rotary blower of the backflow type including:

a housing defining two parallel, transversely overlapping, cylindrical chambers having internal cylindrical and end wall surfaces, the axes of the cylindrical chambers defining a longitudinal direction and the end walls defining a transverse direction, and each intersection of the cylindrical wall surfaces defining a cusp extending in the longitudinal direction between the end walls;

an inlet port and an outlet port having longitudinal and transverse boundaries defined on opposite sides of the chambers with the transverse boundaries of each port disposed on opposite sides of a plane extending longitudinally through the cusps;

meshed, lobed rotors rotatably disposed in the chambers, the ends of the rotors and lobes sealing cooperating with the end wall surfaces, each lobe of each rotor having a top land sealingly cooperating with the cylindrical wall surface of the associated chamber and operative to transverse the port boundaries disposed on the associated side of the plane for effecting transfer of volumes of compressible inlet port fluid to the outlet port via spaces between adjacent unmeshed lobes and each rotor, the lobes being formed with a helical twist such that each lobe has a leading end and a trailing end in the direction of rotor rotation, and the positioning of the lobes being such that traversal of a portion of the plane associated with the outlet port cusp by the lobe lead end of one rotor communicates a transfer volume of one rotor with a transfer volume of the other rotor independent of the outlet port; the improvement comprising:

skewing the outlet port toward the trailing ends of the lobes with the boundaries of the outlet port being disposed such that the lead ends of the lobes transverse said plane portion prior to traversal of the outlet port boundaries by the lobe top lands; and a backflow passage extending traversely through the cusp associated with said outlet port, said backflow passage being disposed at the longitudinal end of the outlet port cusp associated with the lead ends of the lobes for intercommunicating transfer volumes of one rotor with transfer volumes of the other rotor prior to the lobe lead ends of the one rotor traversing said plane portion.

2. The rotary blower of claim 1, wherein said backflow passage is formed by removal of a portion of the outlet port cusp.

3. The rotory blower of claim 1, wherein the ends of said backflow passage tangently intersect said cylindrical wall surfaces.

4. The rotary blower of claim 1, wherein a portion of the outlet port transverse boundaries on both sides of said plane are disposed substantially parallel to the associated lobes when traversed.

5. The rotary blower of claim 1, further including:

first and second expanding orifices defined by transverse wall extensions of the outlet port boundaries and traversing of the transverse wall extentions by the lobes prior to traversal of the outlet port boundaries.

6. The rotary blower of claim 1, wherein said inlet port opening is skewed toward the lead ends of the lobes to increse the number of rotational degrees that the trailing lobe of each transfer volume is in sealing cooperation with said wall surfaces prior to traversal of said outlet port boundaries by the leading lobes of each transfer volume.

7. The rotary blower of claim 6, further including:

first and second expanding orifices defined by transverse wall extensions of the outlet port boundaries and traversing of the transverse boundaries by the lobes is prior to traversal of the outlet port boundaries.

8. The rotary blower of claim 6, wherein a portion of the outlet port transverse boundaries on both sides of said plane are disposed substantially parallel to the associated lobes when traversed.

9. The rotary blower of claim 8, further including:

first and second expanding orifices defined by transverse wall extentions of the outlet port boundaries and traversing of the transverse wall extensions by the lobes is prior to traversal of the outlet port boundaries.

10. The rotary blower of claim 6, wherein at least a portion of the transverse boundaries of the inlet and outlet ports are disposed substantially parallel to the associated lobes when traversed.

11. The rotary blower of claim 10, wherein the helical twist of said lobes is substantially equal to the relation 360°/2n, where n equals the number of lobes per rotor.

12. The rotary blower of claim 11, wherein n equals three.

* * * * *